US006948622B2

(12) United States Patent
Brownfield et al.

(10) Patent No.: US 6,948,622 B2
(45) Date of Patent: Sep. 27, 2005

(54) MODULAR FOOTWEAR DISPLAY AND STORAGE SYSTEM AND METHOD

(75) Inventors: Scott E. Brownfield, Canal Winchester, OH (US); Sebastian Calimeri, Jamestown, NY (US)

(73) Assignee: DSW Shoe Warehouse, Inc., Columbus, OH (US)

( * ) Notice: Subject to any disclaimer, the term of this patent is extended or adjusted under 35 U.S.C. 154(b) by 0 days.

(21) Appl. No.: 10/386,996

(22) Filed: Mar. 12, 2003

(65) Prior Publication Data

US 2004/0178155 A1 Sep. 16, 2004

(51) Int. Cl.[7] ..... A47F 7/08
(52) U.S. Cl. ..... 211/36
(58) Field of Search ..... 211/34, 36, 37, 211/94.01, 162, 184; 312/234, 243

(56) References Cited

U.S. PATENT DOCUMENTS

| | | | | | |
|---|---|---|---|---|---|
| 118,458 | A | | 8/1871 | Jordan | |
| 653,699 | A | | 7/1900 | Robinson | |
| 870,993 | A | * | 11/1907 | Richardson | 211/36 |
| 1,603,590 | A | | 10/1926 | Gardner et al. | |
| 1,649,061 | A | * | 11/1927 | Ensrud | 312/351 |
| 1,720,564 | A | | 7/1929 | Noble | |
| 1,821,024 | A | | 1/1931 | Noble | |
| 2,098,828 | A | | 11/1937 | Ludwick | |
| 2,285,491 | A | | 6/1942 | Clark | |
| 2,458,194 | A | | 1/1949 | Panosh | |
| 2,462,611 | A | | 2/1949 | Bye | |
| 2,495,109 | A | | 1/1950 | Kramer | |
| 2,536,059 | A | * | 1/1951 | Igler | 211/90.04 |
| 2,817,443 | A | | 12/1957 | Payne | |
| 3,092,257 | A | | 6/1963 | Rountree | |
| 3,408,128 | A | | 10/1968 | Kump | |
| 3,552,576 | A | * | 1/1971 | Lahr | 211/36 |
| 3,788,241 | A | * | 1/1974 | Ravreby | 108/6 |
| 3,879,095 | A | | 4/1975 | Seamans et al. | |
| 3,995,925 | A | | 12/1976 | Roesler | |
| 4,008,807 | A | | 2/1977 | Phillips | |
| 4,133,589 | A | | 1/1979 | Johns | |
| 4,220,245 | A | | 9/1980 | Corcoran | |
| 4,611,717 | A | * | 9/1986 | Hutson | 211/34 |
| 5,960,965 | A | | 10/1999 | Saunders | |
| 5,992,648 | A | | 11/1999 | Saunders | |
| 6,164,215 | A | * | 12/2000 | Cook et al. | 108/60 |
| 6,471,080 | B1 | * | 10/2002 | Hoffmann | 211/126.1 |
| 6,471,309 | B1 | | 10/2002 | Turner | |
| 6,520,355 | B1 | * | 2/2003 | Pritchard et al. | 211/187 |
| D478,435 | S | | 8/2003 | Brownfield | |

* cited by examiner

*Primary Examiner*—Hugh S. Thompson, II
*Assistant Examiner*—Sarah Purol
(74) *Attorney, Agent, or Firm*—Wood, Herron & Evans

(57) ABSTRACT

A modular footwear display system includes a display module having a display surface for supporting an item of footwear and a divider for identifying boxed footwear associated with the displayed item of footwear. The display module has at least one mounting fixture for slidably suspending the display surface from a track. A plurality of display modules may be provided in a cabinet and adjusted to accommodate varying quantities of boxed footwear for efficient use of retail space.

10 Claims, 6 Drawing Sheets

MODULAR FOOTWEAR DISPLAY AND STORAGE SYSTEM AND METHOD

FIELD OF THE INVENTION

The present invention pertains to display and storage devices, and more particularly a modular footwear display and storage system.

BACKGROUND OF THE INVENTION

Shoes are merchandised in stores in two principal modes. One traditional approach is to have a display area containing a sample of each different type of shoe available for sale. The customer advises a sales clerk as to the style and size that is desired, which the clerk then returns from a storeroom which is unaccessible to customers, and gives it to the customer to try on for fit, etc. Often, the customer will be frustrated to discover that the size for a desired style is not available, requiring the customer to make a further search for another style that may or may not be available in the desired size. Such practice is generally inefficient when there are a large number of customers desiring to be served. Furthermore, customers may prefer to browse available styles at their leisure without the assistance of a sales clerk.

A second shoe merchandising approach, requiring no sales clerk assistance, involves providing one or more stacks of boxed shoes of a given style on the floor or a low shelf, with the top box of at least one stack open to display the style of shoes in the boxes in the stacks. The stacks for the different styles being offered are typically located side-by-side in long rows, or aisles. As a consequence, customers can select their size in a particular style without need for a sales clerk. While this "self service" approach has many advantages, there are also some problems. For example, the open box containing the "display" pair of shoes may be inadvertently shifted to a stack of shoes different than that contained in the open box. As a consequence, customers encounter difficulty locating boxes containing the "displayed shoes," rendering it more difficult to find the "displayed shoe" in their size.

Another problem is that existing schemes for storing and displaying shoes in self-service footwear stores do not readily and conveniently accommodate, on a space-efficient basis, situations where the inventory of different styles varies from style to style at any given time, and/or the inventories of the different styles vary from style to style to different extents over a period of time. Stated differently, prior self-service shoe display and storage systems are not readily reconfigurable or adaptable to account for varying quantities of boxes in each size, such as when initial inventories of different styles vary and/or the different styles sell at different rates.

There is thus a need for a footwear display and storage system which permits retailers to provide substantially all of their stock on display in a showroom in an organized fashion, which permits customers to peruse various footwear styles, to quickly and easily ascertain if a particular size is available in a desired style, and which efficiently and conveniently enables the stacks of the different shoe styles to be rearranged as inventories of the different styles change over time and/or initial inventories of the different styles differ at the outset.

SUMMARY OF THE INVENTION

The present invention provides a modular footwear display and storage system that permits retailers to provide substantially an entire stock of shoes of varying style to customers who may browse the styles and select a desired item of footwear for purchase without the assistance of a sales clerk. The system includes display modules that facilitate the display of an item of footwear and the identification of boxed footwear corresponding to that particular style. The modules are repositionable so that the system may be adapted to accommodate varying quantities of footwear available at a given time. For example, the modules may be arranged to accommodate differing initial quantities of various footwear styles. In addition, the system may be continuously modified to accommodate changes in available quantities for individual styles, particularly when different styles are depleted at different rates as a result of varying demand for the different styles.

In one aspect of the invention, the display and storage system includes plural display and stack divider modules each having a generally horizontal display surface, for displaying one style of footwear, and a vertical divider extending downwardly therefrom for aligning boxes of shoes of that style in a stack under the displayed style. The system further includes at least one horizontally extending module mounting member, preferably a rail or track, configured to suspend the modules from the rail or track for horizontal sliding movement along the rail or track to selectively variable positions therealong.

Accordingly, boxes of footwear may be placed onto the storage and display system and the vertical divider of the module may be used to divide and align stacks of boxes of a particular style of footwear and to separate those stacks from stacks of boxes of footwear of other styles. Advantageously, a sample of the footwear style contained in the boxes associated with a module may be displayed on the display surface overlying a stack of boxes containing the displayed style to permit consumers to examine the footwear and readily identify boxes of footwear of the displayed style available for purchase. As the inventory of footwear is depleted due to purchases, or increased by the receipt of new inventory, the modules may be shifted horizontally in the display system, as required, to increase or decrease the space for storing stacked boxes of footwear of the various styles.

In yet another aspect of the invention, a display and storage system for boxed footwear includes a vertical support member extending upward from a base, and at least one horizontally extending module mounting member coupled to the vertical support member. In an exemplary embodiment, the module mounting member is a track and the modules include rollers which may be received on the track to slidably suspend the modules from the track. In another embodiment, module mounting members may be provided on opposite sides of the vertical support member to obtain a configuration of back-to-back series of display and stack divider modules. In another embodiment, the display and storage system may include more than one horizontally extending module mounting member, whereby module mounting members can be secured to respective vertical support members at different elevations to provide a tiered arrangement. In each embodiment, a plurality of display and stack divider modules may be horizontally adjustably coupled to the module mounting members to create a footwear display that is readily adapted to meet the changing needs of the retailer.

In another aspect of the invention, a method of displaying footwear and dividing stacks of boxes containing footwear of various styles includes providing plurality of modules, each module having a display configured to support at least one item of footwear, a divider, and at least one module connection element configured to engage a module support member of a display system; mounting the modules on the module support member; providing a plurality of different footwear styles on the different displays; spacing the modules along the module support member; and stacking boxes of footwear corresponding to the different styles of footwear under the displays, with the dividers of the respective modules separating adjacent box stacks of the different footwear styles.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
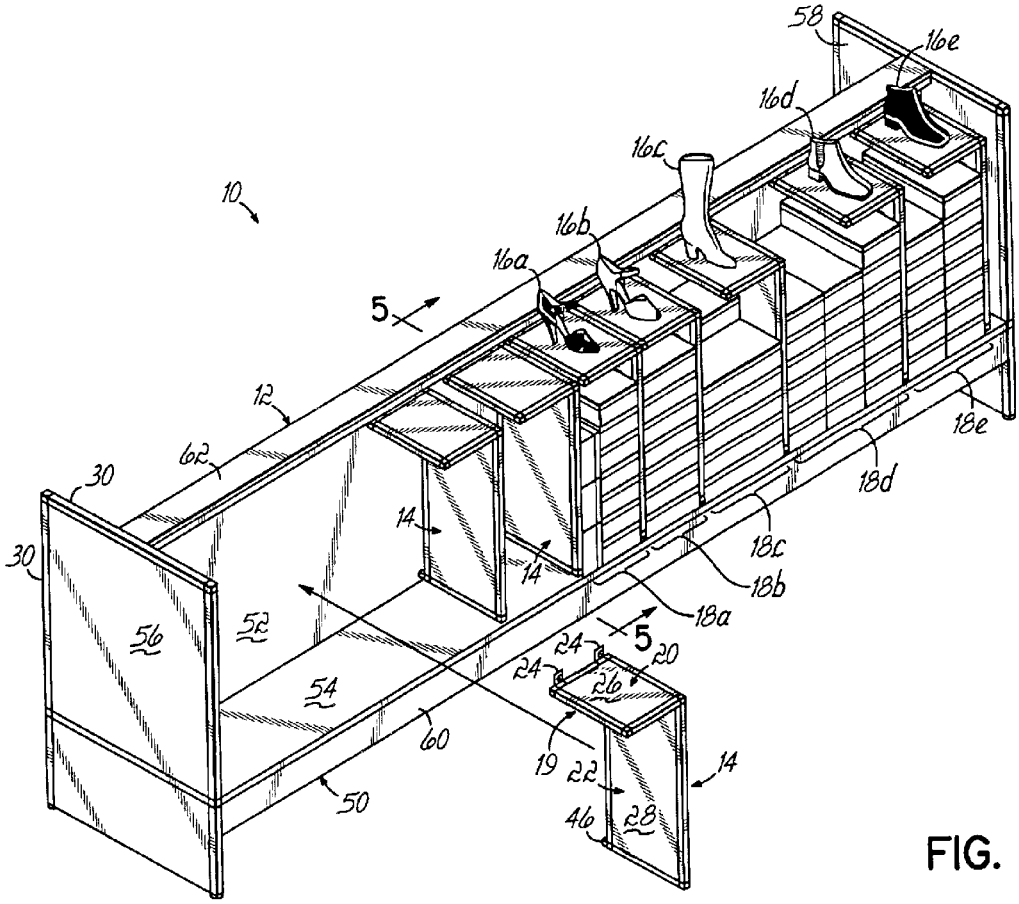
FIG. 1 is a perspective view of an exemplary modular footwear display and storage system, according to the present invention.

With reference to FIG. 1, there is shown an exemplary modular footwear display and storage system 10 according to the present invention. The modular footwear display and storage system 10 includes an open cabinet 12 which is configured to receive a plurality of footwear display and divider modules 14 that may be slidably mounted within the cabinet 12 to display individual samples of footwear 16*a*–16*e* and to separate boxes 18*a*–18*e* of footwear respectively associated with each of the individual displayed samples.

Figure 2:
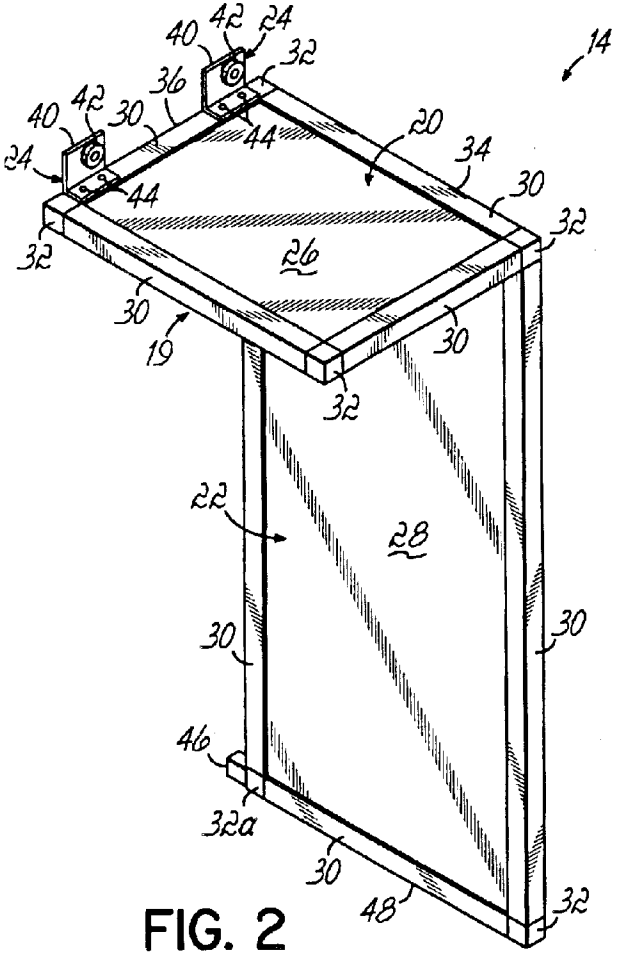
FIG. 2 is a perspective view of an exemplary footwear display and stack divider module of the system of FIG. 1.

As shown more clearly in FIG. 2, module 14 includes a display 19 having a horizontal display surface 20 for supporting at least one item of footwear 16 and a vertical divider 22 extending generally perpendicular to the display surface 20 such that when the module 14 is slidably coupled to the cabinet 12, divider 22 operates to identify boxes associated with the item of footwear displayed on its respective display surface 20 and to separate those associated boxes from boxes of other footwear located adjacent thereto, as illustrated in FIG. 1. With continued reference to FIG. 2, module 14 further includes one or more module connection elements, or module mounting fixtures, 24 for slidably coupling the module 14 to the cabinet 12, as will be described more fully below.

Figure 3:
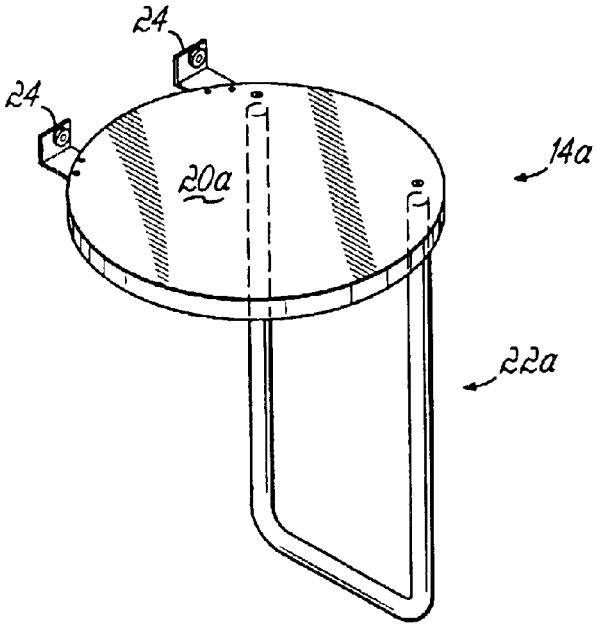
FIG. 3 is a perspective view of another exemplary footwear display and stack divider module, similar to FIG. 2.

In the exemplary embodiment shown, display surface 20 and divider 22 of the display and stack divider module 14 comprise panels 26, 28 having a generally rectangular configuration. It will be recognized, however, by those skilled in the art, that display surface 20 and divider 22 may have various other configurations. For example, display surface 20 and divider 22 may have triangular, oval, or circular shapes, or may be constructed from elongate, spaced rods or bars, or may have any other configuration suited to support an item of footwear and separate adjacent stacks of boxes of footwear as described above. FIG. 3, for example, depicts an exemplary module 14*a* having a generally circular display surface 20*a* and a divider 22*a* comprising a U-shaped tube coupled to the display surface 20*a*.

In the exemplary embodiment shown in FIG. 2, the panels 26, 28 comprise laminated wood plies, such as melamine, that are surrounded at their margins by channels or tubing 30 having a generally square cross-section. The tubing 30 is formed from aluminum extrusion and has "lipped" sides for engaging the panels 26, 28. Sections of tubing 30 along adjacent edges of the panels 26, 28 are joined by corner caps 32 configured to receive the ends of the tubes 30. In the exemplary embodiment shown, the divider 22 is joined to the display surface 20 along a lateral edge 34 of the display surface and mounting fixtures 24 are secured along the rear edge 36 of the display surface 20. Each mounting fixture 24 includes an angled bracket 40 having a roller 42 coupled to a portion of the bracket that extends upwardly from display surface 20. Brackets 40 are secured to display surface 20 by fasteners 44. Display module 14 further includes a horizontal extension or bumper 46 disposed at a lower rear end 48 of the divider 22 for engaging cabinet 12 and to maintain the module 14 in proper orientation within the cabinet 12 such that the display surface 20 is horizontal. In the exemplary embodiment shown, the bumper 46 is formed from a corner cap 32*a* provided with a protrusion that extends rearwardly of the divider 22 when module 14 is installed in cabinet 12.

Figure 4A:
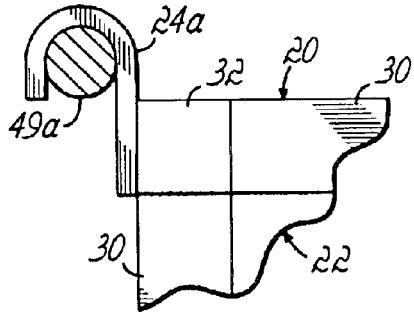
FIGS. 4A–4C are partial cross-sectional views illustrating various alternative support configurations for the display and stack divider module of FIG. 2.
Figure 4B:
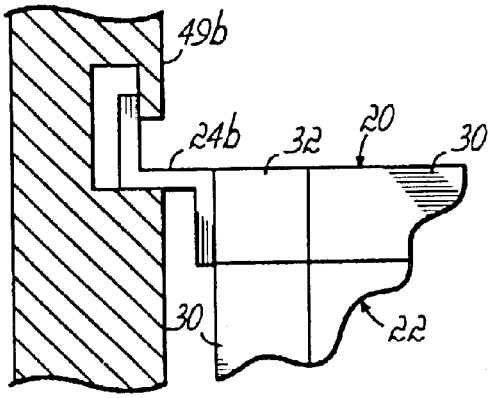
Figure 4C:
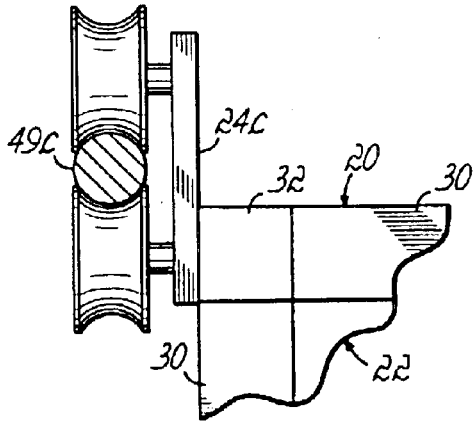

While mounting fixture 24 has been shown and described as an angle bracket 40 with a roller 42, those of ordinary skill in the art will recognize that various other configurations of mounting fixture 24 are possible for slidingly engaging corresponding support structure of a cabinet. For example, the mounting fixture may comprise hook-shaped members, lipped members, or opposed rolling elements. Examples of each of these alternative configurations is depicted in FIGS. 4A–4C, respectively, wherein corresponding elements are similarly numbered and fixtures 24*a*–24*c* engage corresponding support structures 49*a*–49*c*.

Figure 5:
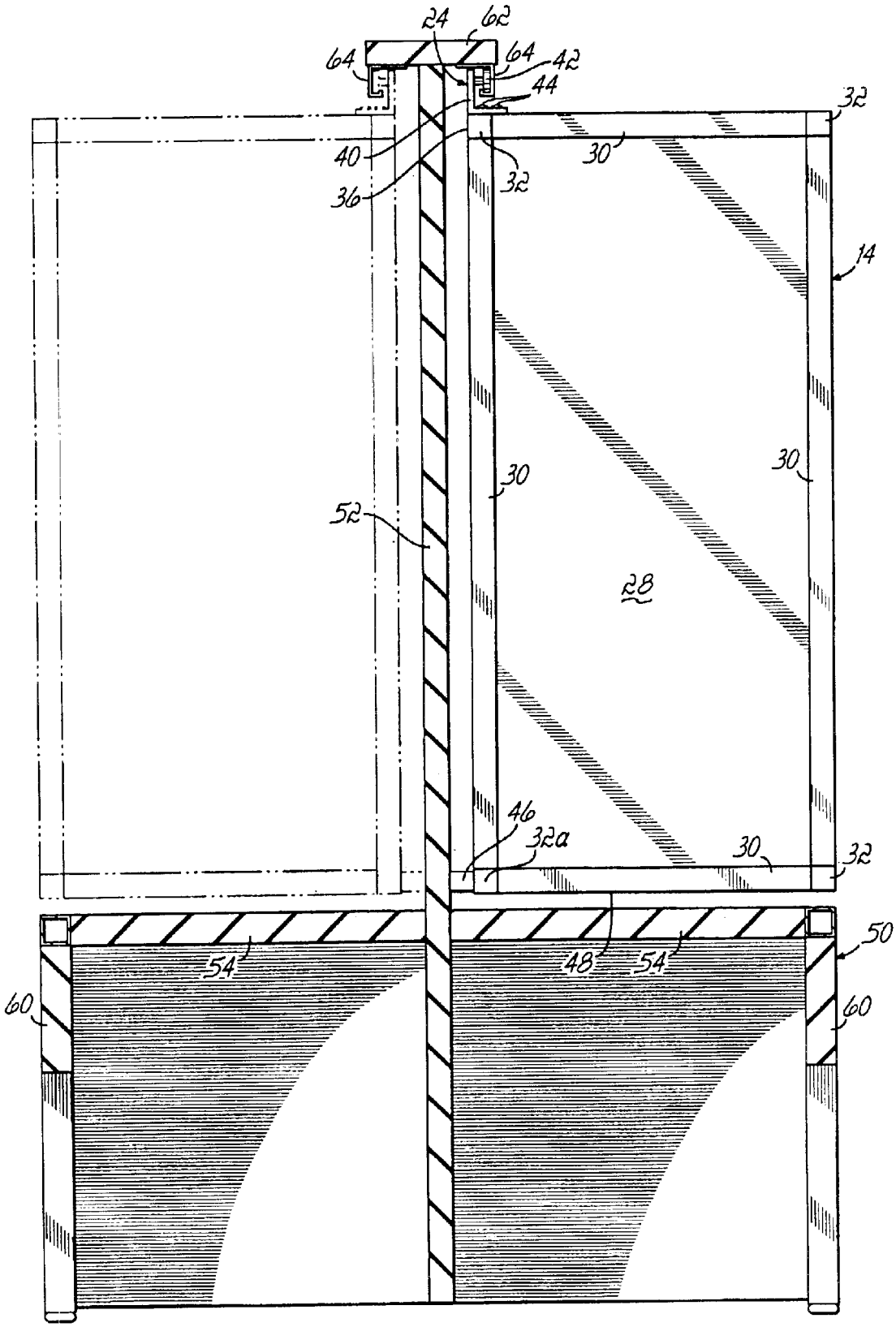
FIG. 5 is a cross-sectional view, taken along lines 5—5 of FIG. 1, and depicting an exemplary footwear display and storage system, according to the present invention.

Referring now to FIGS. 1 and 5, an exemplary open cabinet 12 for receiving display modules 14 will now be described. Cabinet 12 includes a base 50 with at least one vertical support member 52 extending vertically upward from the base 50. In the exemplary embodiment shown, the base 50 includes a shelf 54, upon which shoe boxes 18 may be stored, and vertical end panels 56, 58 at opposing ends of the cabinet 12. A vertical trim panel 60 provided along a front edge of the shelf 54, and a top plate 62 coupled to an upper end of the vertical support member 52, extend the length of the cabinet 12 between the end panels 56, 58. Cabinet 12 further includes a module mounting member in the form of a horizontally extending track 64 secured to the top plate 62 and spaced from the shelf 54 such that rollers 42 of mounting fixtures 24 may be received in the track 64 to thereby slidably suspend a series of display modules 14 within the cabinet 12 for horizontal movement along the track to selectively variable locations.

As illustrated in FIG. 5, the display modules 14 hang from the track 64 and bumpers 46 engage the vertical support member 52 to maintain horizontal orientation of the display surface 20. The bumper 46 may be provided with a rubber pad or other protective surface (not shown) at its free end to prevent marring of the vertical support member 52 and further to help maintain individual modules 14 at desired positions along the length of the display cabinet 12 by frictional engagement of the free end of the bumper and the surface of the support member. In use, when it is desired to reposition an individual display module 14 along the length of the cabinet 12, the lower portion of the module 14 may be tilted slightly outward to move bumper 46 away from engagement with the vertical support member 52 whereafter the module 14 may be easily slid along the length of the cabinet 12 by the rollers 42 engaged in the track 64.

Advantageously, the display modules 14 may be positioned within the cabinet 12 such that the dividers 22 separate adjacent stacks of boxes 18 containing different styles of footwear 16 and the display surface 20 of each module 14 supports a sample of the particular footwear 16 above the boxes 18 containing items of footwear of that particular style available for sale. Because the display modules 14 may be continually adjusted to account for varying initial quantities or varying rates of depletion of the quantities of boxes 18 associated with each item of footwear 16, the display and storage space provided by cabinet 12 is efficiently utilized.

Figure 6:
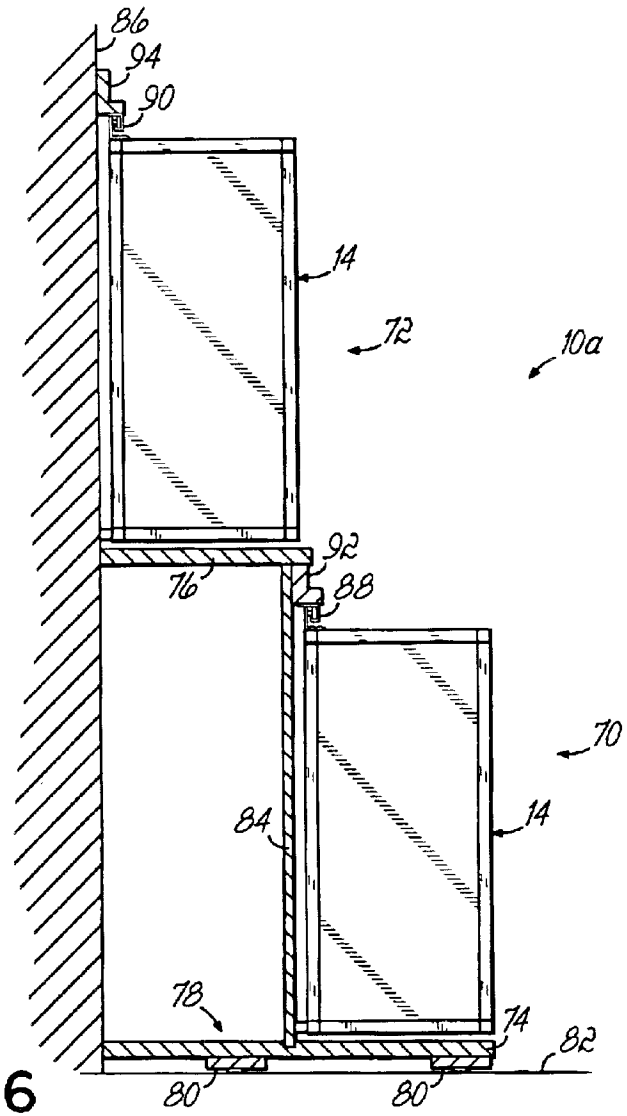
FIG. 6 is a cross-sectional view of another exemplary footwear display and storage system, according to the present invention.

Referring to FIG. 6, there is shown another exemplary embodiment of a footwear display and storage system 10*a* according to the present invention, which incorporates a cabinet having two tiers 70, 72 of modules 14 for displaying items of footwear 16 and identifying associated boxes 18 containing footwear 16 of the displayed style available for sale. In the exemplary embodiment shown, the display and storage system 10*a* includes first and second shelves 74, 76 for supporting boxes 18 of footwear 16 for sale. The first shelf 74 also forms the base 78 of the system 10*a* and is provided with foot members 80 for supporting the first shelf 74 above a floor surface 82. The second shelf 76 is spaced above the first shelf 74 and is at least partially supported by a first vertical support member 84 extending upwardly from the first shelf 74. The second shelf 76 is also supported by a second vertical support member 86 extending upwardly from the first shelf 74 and spaced from the first vertical support member 84. In the exemplary embodiment shown, the second vertical support member 86 comprises a portion of a structural wall of the room in which the system 10*a* resides, but it will be recognized by those of ordinary skill in the art that the second vertical support member 86 may alternatively be a vertical panel similar to the first vertical support member 84.

The footwear display and storage system 10*a* further includes first and second module mounting members in the form of tracks 88, 90 coupled to first and second ledge members 92, 94 which are in turn coupled to the first and second vertical support members 84, 86. The first ledge member 92 is coupled to the first vertical support member 84 beneath the second shelf 76 and the second ledge member 94 is coupled to the second vertical support member 86 at a distance spaced from the second shelf 76 such that a plurality of display modules 14 may be supported from the first and second tracks 88, 90 to thereby create a tiered footwear display system similar to the single-tier system described above with respect to FIG. 1.

Figure 7:
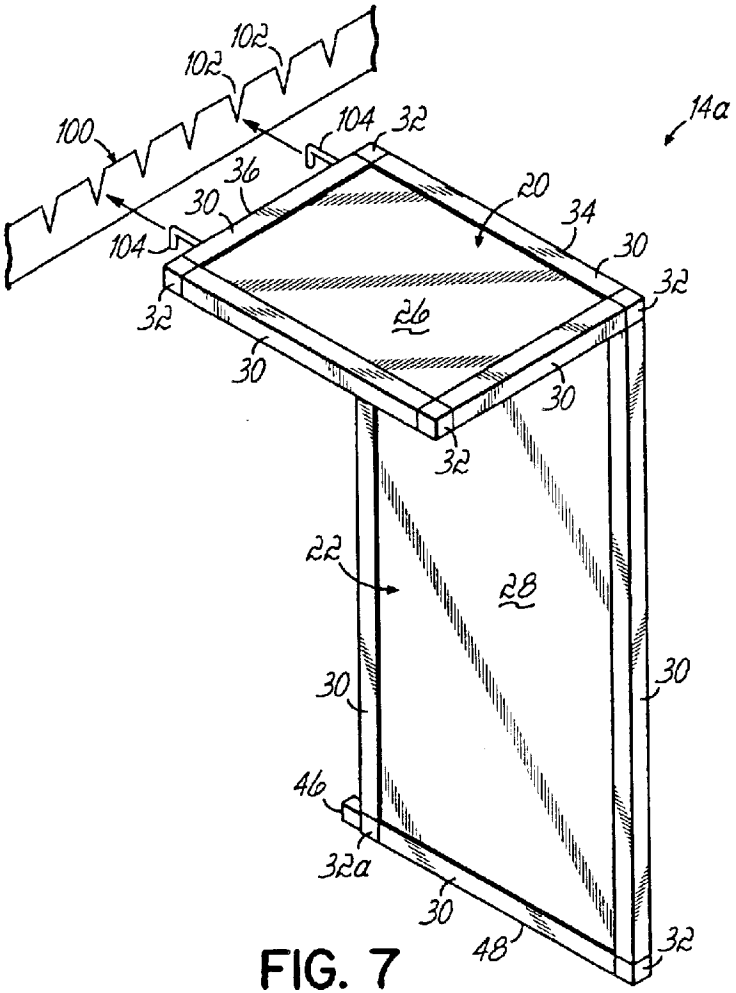
FIG. 7 is a perspective view of another exemplary module and depicting an alternate module mounting configuration.

While the exemplary display and storage systems have been described above as having modules 14 supported for sliding movement along module mounting members, it will be recognized that modules 14 may alternatively be supported on a horizontally disposed module mounting member for selective placement of the modules at different horizontal locations along the module mounting member without sliding. For example, a module mounting member may be configured to define a plurality of discrete horizontal positions along the module mounting member at which individual modules may be selectively placed. FIGS. 7–9 depict several examples of module mounting members and corresponding modules which may be selectively positioned without sliding. FIG. 7 depicts an exemplary horizontally disposed module mounting member 100 that includes a plurality of notches 102 configured to receive hooks 104 extending rearwardly from the rear edge of the display surface 20 of module 14*a*.

Figure 8A:
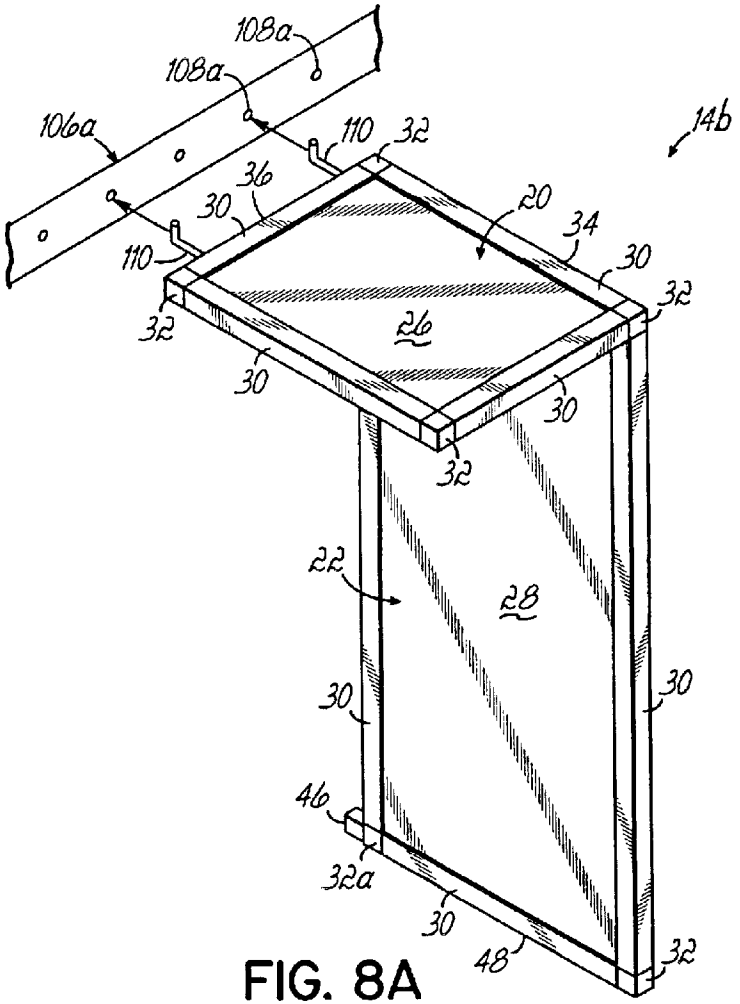
FIGS. 8A–B are perspective views of exemplary modules, depicting additional alternative module mounting configurations.
Figure 9:
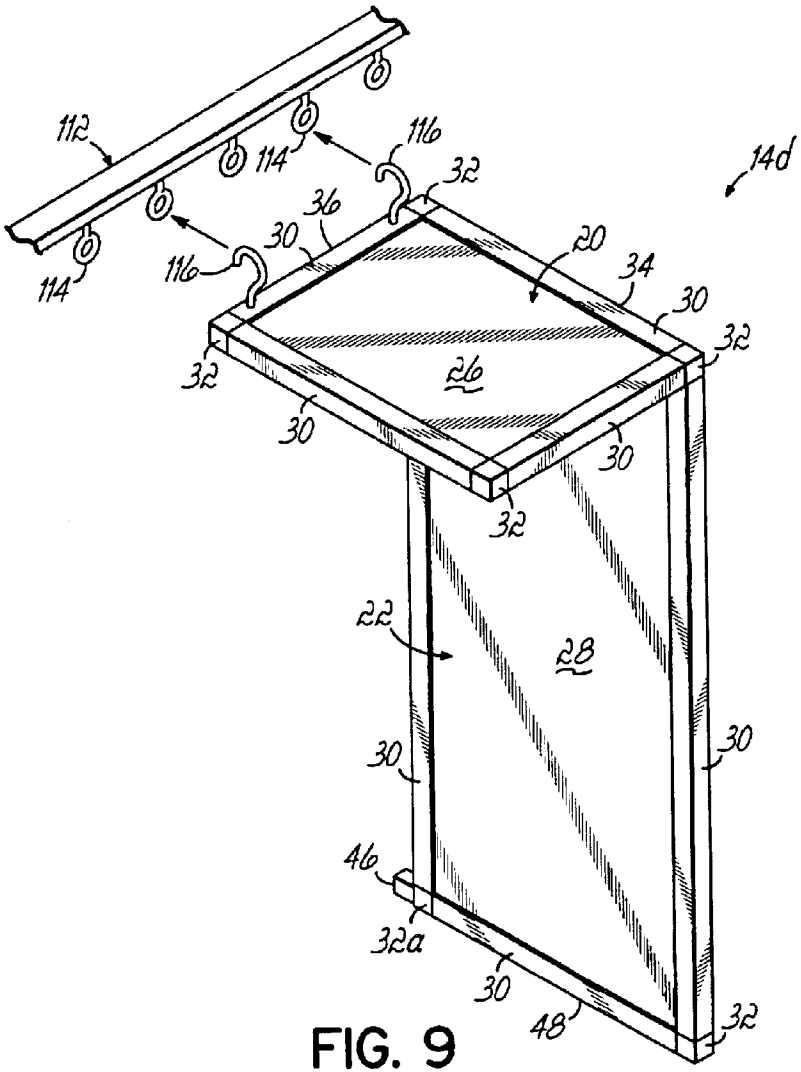
FIG. 9 is a perspective view of an exemplary module, depicting yet another alternative module mounting configuration.
Figure 8B:
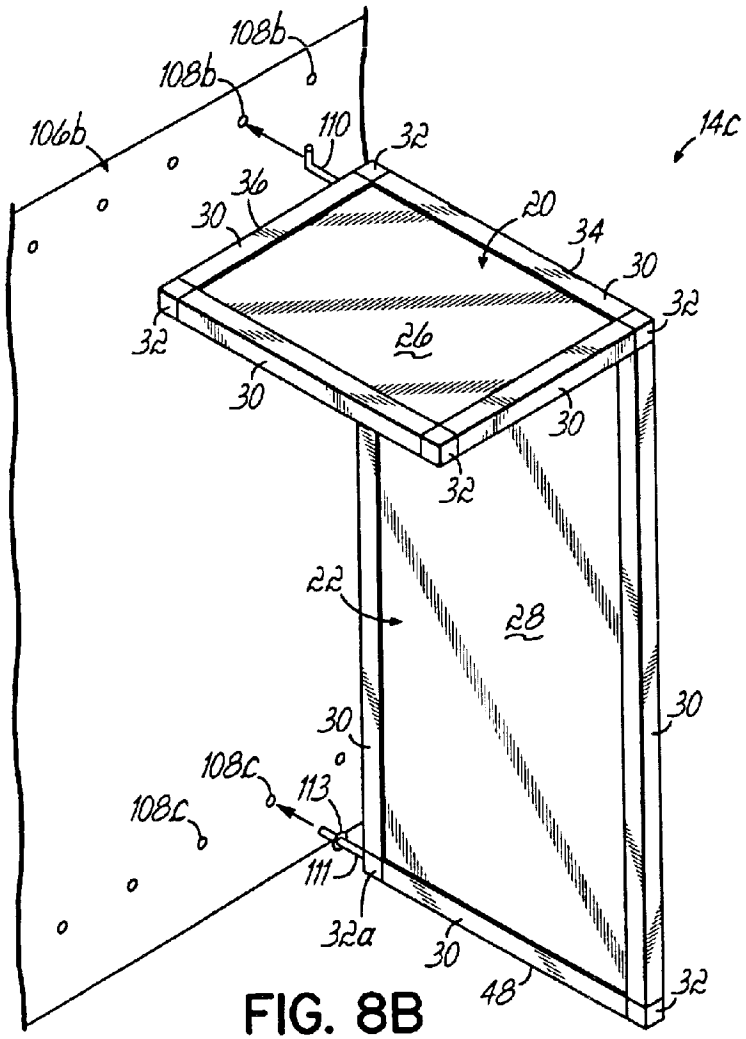

FIGS. 8A–8B depict exemplary embodiments wherein modules are coupled to module mounting members with "peg-board" type connections. In FIG. 8A, mounting member 106*a* comprises an elongate, horizontally disposed member having a series of horizontally spaced holes 108*a*. In this embodiment, module 14*b* includes a pair of mounting elements in the form of hooks 110 disposed at spaced horizontal positions along the rear edge of the display surface 20 whereby the hooks 110 may be inserted through different pairs of holes 108*a* to engage the module mounting member 106*a* at different locations therealong. In FIG. 8B, module mounting member 106*b* includes a first series of horizontally spaced holes 108*b* and a second series of horizontally spaced holes 108*c*, wherein corresponding holes 108*b*, 108*c* are spaced vertically apart. In this embodiment, module 14*c* includes mounting fixtures in the form of vertically spaced hooks 110 and pins 111 adjacent divider 22, whereby hooks 110 and pins 111 may be inserted through holes 108*b*, 108*c* to engage the module mounting member 106*b*. Pins 111 include stop collars 113 that control the depth of insertion of the pins 111.

In FIG. 9, the horizontal module mounting member 112 comprises a series of horizontally spaced eyes or hooks 114 and module 14*d* includes mounting elements in the form of corresponding hooks 116, mounted to the rear edge of the horizontally disposed display surface 20. Accordingly, hooks 116 may be coupled with different pairs of eyes 114 to suspend module 14*d* at different horizontal locations.

The modular footwear display and storage system 10 of the present invention provides a convenient way for retailers to display numerous varieties of footwear in a showroom, while also storing corresponding boxes of the footwear available for purchase by customers who may easily identify and select desired footwear from the display and storage system 10 without the assistance of a sales clerk. The display and storage system 10 utilizes space efficiently and is readily adaptable to accommodate varying quantities of boxed footwear. The system 10 may also be provided in a variety of configurations to suit available space, as illustrated by the exemplary embodiments shown and described herein. Advantageously, the structural components of exemplary cabinets 12, 12*a*, such as shelves 54, 74, 76, bases 50, 78, end panels 56, 58 and vertical support members 52, 84, 86 described above, may be assembled from panel and tube sections similar to those used to construct the individual display modules 14.

It is also contemplated that the modular display and storage system of the present invention could be adapted to display and store various other retail items in a manner similar to that described herein. For example, the system may be modified to display and store items of clothing, foodstuffs, hardware, or various other retail items by altering the dimensions and/or the display, the divider, or other features of the modular display and storage system to accommodate the particular item desired to be displayed and stored.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A footwear display and stack divider module, adapted to be selectively variably supportably positioned on a module support member which extends in a generally horizontal direction, comprising:

a footwear display configured to support at least one style of footwear and having a rear edge and a lateral edge;

a divider disposed adjacent said lateral edge of said display and extending downwardly from said display, said divider defining a vertical plane; and at least one module connection element disposed adjacent said rear edge of said display, said module connection element configured to selectively engage the module support member at different horizontal positions therealong;

said vertical plane being generally perpendicular to the horizontal direction of the module support member when the module is supported thereby;

wherein the module support member comprises a track and said module connection element includes at least one roller configured to engage the track to thereby slidably suspend the module therefrom.

2. A system for displaying and storing footwear, the system comprising:

at least one horizontally extending module support member; and a plurality of display modules coupled to said module support member, each said module comprising:

a display configured to support at least one item of footwear and having a rear edge and a lateral edge, a divider disposed adjacent said lateral edge of said display and extending in a generally vertical direction downwardly therefrom, and at least one module connection element disposed adjacent said rear edge of said display, said module connection element configured to engage said horizontally extending module support member to thereby facilitate selective placement of said module at different horizontal locations along said module support member;

wherein said module support member comprises a horizontally extending elongated track and each said module connection element includes at least one roller configured to engage said track to thereby slidably suspend said module therefrom with said divider disposed in a generally vertical direction perpendicular to the elongated module support track.

3. A cabinet for displaying and storing footwear, the cabinet comprising:

a base;

at least one vertical support member extending upwardly from said base;

at least one module support member coupled to said vertical support and spaced from said base; and a plurality of display modules coupled to said module support member, each said module comprising:

a display configured to support at least one item of footwear and having a rear edge and a lateral edge, a divider disposed adjacent said lateral edge of said display and extending in a generally vertical direction downwardly therefrom, and at least one module connection element disposed adjacent said rear edge of said display, said module connection element configured to engage said horizontally extending support member to thereby facilitate selective placement of said module at different horizontal locations along said module support member;

wherein said module support member comprises a horizontally extending elongated track and each said module connection element includes at least one roller configured to engage said track to slidably suspend a respective module therefrom, with said divider disposed in a generally vertical direction perpendicular to said track.

4. A method of displaying and storing footwear, comprising:

stacking containers of footwear of a first style in a least one vertical stack, one on top of the other in direct physical contact;

stacking containers of footwear of a second style in at least one vertical stack, one on top of the other in direct physical contact, said stack of containers of footwear of said second style being located adjacent the stack of containers of footwear of the first style;

selectively positioning a generally vertically disposed, horizontally movably positionable stack divider between (i) the at least one stack of containers of the first style and (ii) the at least one stack of containers of the second style of footwear;

displaying a sample of footwear of the first style above the at least one stack of containers of the first style of footwear; and displaying a sample of footwear of the second style above the at least one stack of containers of the second style of footwear.

5. The method of claim 4, further comprising:

repositioning the divider to adjust the location of a boundary between the stacks of containers of the first and second styles of footwear.

6. The method of claim 4, wherein selectively positioning the horizontally movably positionable divider between the stacks of said first and second styles of footwear comprises variably positionably supporting the divider from a horizontally disposed support arranged generally perpendicular to the divider.

7. The method of claim 4, wherein displaying the samples of the first and second footwear styles comprises:

variably positionably supporting a first shelf and a second shelf from a horizontally disposed support arranged generally perpendicular to the divider, at locations above the at least one stack of the first footwear style and the at least one stack of the second footwear style, respectively; and placing the samples of the first and second footwear styles on the first and second shelves, respectively.

8. The method of claim 4, wherein:

selectively positioning the horizontally movably positionable divider between the stacks of said first and second styles of footwear comprises variably positionably supporting the divider from a horizontally disposed support arranged generally perpendicular to the divider; and wherein displaying the samples of the first and second footwear styles comprises variably positionably supporting a first shelf and a second shelf from a horizontally disposed support, at locations above the at least one stack of the first footwear style and the at least one stack of the second footwear style, respectively, and placing the samples of the first and second footwear styles on the first and second shelves respectively.

9. A system for displaying and storing footwear, comprising:

a horizontally disposed support;

a first shelf selectively variably positioned along said support and extending horizontally outwardly therefrom;

at least one vertical stack of stackable containers of footwear of a first style stacked one on top of the other in direct physical contact beneath said first shelf;

a second shelf selectively variably positioned along said support and extending horizontally outwardly therefrom;

at least one vertical stack of stackable containers of footwear of a second style stacked one on top of the other in direct physical contact beneath said second shelf;

a first vertically disposed divider selectively variably positioned along said support and extending outwardly therefrom in a substantially perpendicular direction relative to said horizontally disposed support, said first divider separating said at least one stack of containers of the first style of footwear from an adjacent stack of containers in the system which contain footwear of the second style; and a second vertically disposed divider selectively variably positioned along said support and extending outwardly therefrom in a substantially perpendicular direction relative to said horizontally disposed divider, said second divider separating said at least one stack of containers of the second style of footwear from an adjacent stack of containers in the system which contain footwear of a style different than said first and second styles;

said vertical stacks of containers unobstructed along an outwardly facing side thereof, opposite said horizontally extending support, such that each container is selectively individually removable from said stacks without removing other containers from said stacks.

10. The system of claim 9, wherein said dividers have generally vertical inner and outer edges defining respective planes, with said outer edges more remotely spaced from said horizontally disposed support than said inner edges, the system being free of structure that inhibits said containers from being withdrawn from said respective stacks in a horizontal direction which is both (i) parallel to said plane of said dividers associated with said stack from which said container is being withdrawn, and (ii) away from said outer edges of said associated dividers.

* * * * *